United States Patent [19]

Clark

[11] 4,058,692

[45] Nov. 15, 1977

[54] CONTACT BREAKER ASSEMBLY WITH BREAKER ARM SPACER BLOCK

[76] Inventor: William E. Clark, 246 E. J-12 Ave., Lancaster, Calif. 93534

[21] Appl. No.: 745,738

[22] Filed: Nov. 29, 1976

[51] Int. Cl.[2] ..... H01H 19/62

[52] U.S. Cl. ..... 200/31 A; 200/30 A; 200/30 AA

[58] Field of Search ..... 200/19 A, 31 R, 31 A, 200/31 DP, 30 A, 30 R, 30 AA; 29/622

[56] References Cited

U.S. PATENT DOCUMENTS

| | | | |
|---|---|---|---|
| 1,250,904 | 12/1917 | Leece | 200/30 A |
| 2,709,207 | 5/1955 | Udale | 200/30 A |
| 2,740,853 | 4/1956 | Hartman, Jr. | 200/30 A |
| 3,025,364 | 3/1962 | Caramanna | 200/30 A |
| 3,629,527 | 12/1971 | Fry | 200/30 AA X |
| 3,833,777 | 9/1974 | Clark | 200/31 A |
| 3,956,602 | 5/1976 | Clark | 200/31 A |

*Primary Examiner*—James R. Scott
*Attorney, Agent, or Firm*—H. Ross Workman; J. Winslow Young

[57] ABSTRACT

A distributor breaker contact spacing mechanism for a distributor of an internal combustion engine. The mechanism includes an oscillatory breaker arm having a contact point and a cam follower, the cam follower being resiliently urged toward an engine-operated cam. Rotation of the cam provides a reciprocatory movement to the breaker arm thereby sequentially making and breaking the contact between the movable contact and a stationary contact. A spacing block is mounted upon the movable arm and accommodates the establishment of the appropriate gap distance that the movable contact point moves away from the stationary contact point in response to rotation of the cam. The spacing block substantially eliminates adjustment of the spacing gap between the contact points upon installation of the breaker point assembly in the distributor.

4 Claims, 5 Drawing Figures

CONTACT BREAKER ASSEMBLY WITH BREAKER ARM SPACER BLOCK

BACKGROUND

1. Field of the Invention

This invention relates to pre-gapped breaker point assemblies for distributors of internal combustion engines.

2. The Prior Art

Spark plug systems for internal combustion engines incorporate a distributor apparatus to suitably direct electrical energy to the appropriate spark plug to produce an electrical spark which ingites the fuel/air mixture in the cylinder. A significant aspect of accurately timing the spark initiation is in the gap distance by which the contact points of a mechanical distributor system separate during operation.

Mechanical breaker point assemblies generally include a spring-biased, oscillatory breaker arm with a movable contact mounted on the end thereof. A stationary contact is mounted on a stationary bracket and placed to intercept the movable contact. The breaker arm and the bracket are both mounted on what is commonly referred to as a breaker plate. The breaker plate is adapted to be secured in the distributor of an internal combustion engine.

The oscillatory breaker arm includes a cam follower which is resiliently urged against an engine-rotated cam. Rotation of the cam imparts an oscillatory movement to the breaker arm. The oscillatory movement of the breaker arm provides a sequential contact between the movable contact and the stationary contact. Conventional mechanical distributiors are configurated such that the maximum gap distance between contact points is obtained coincident with the cam follower at a high point or lobe of the cam. Conventional breaker point assemblies also incorporate adjustment means for suitably positioning the breaker point assembly with respect to the distributor and the cam so as to obtain the appropriate gap distance between the fixed and the movable contact point when the cam follower is at a high point on the cam.

It is common knowledge that the distributor contact points eventually become worn and require replacement. Replacement of worn contact points has historically been accomplished by replacement of the entire breaker point assembly in the distributor, including the breaker arm and the stationary contact bracket. Replacement is accomplished by careful adjustment to obtain the appropriate gap distance between the contact points. Historically, this adjustment procedure generally requires the services of an experienced mechanic since it is a relatively difficult task for the layman.

Pre-gapped breaker point assemblies are dislcosed and claimed in each of my previous patents, U.S. Pat. No. 3,833,777, issued Sept. 3, 1974, for PRE-GAPPED BREAKER POINT ASSEMBLIES and U.S. Pat. No. 3,956,602, issued Feb. 12, 1975, for PRE-GAPPED BREAKER ASSEMBLY. Each of these patents relate to spacing block apparatus wherein the spacing block is mounted upon the stationary bracket.

However, it is currently believed that it would be an improvement in the art to provide a spacing block assembly mounted upon the oscillatory breaker arm. This spacing block assembly would accommodate setting the correct gap distance for the contact points with a minimal amount of subsequent adjustments required after the replacement breaker point assembly has been placed in the distributor.

BRIEF SUMMARY AND OBJECTS OF THE INVENTION

The present invention includes a spacing block mounted upon the oscillatory breaker arm of a breaker point assembly. The spacing block readily accommodates setting a predetermined gap distance for the contact points when the cam follower is at a high point on the cam. Selectively, the spacing block assembly may be removably mounted upon the breaker arm so as to accommodate removal therefrom after the appropriate installation has been made in the breaker point assembly. Advantageously, the present invention makes it possible for persons of relatively little mechanical skill to readily replace worn contact points while, simultaneously, being able to obtain the appropriate gap distance between the contact points.

It is, therefore, a primary object of this invention to provide an improved breaker point assembly for a distributor of an internal combustion engine.

Another object of this invention is to provide an improved pre-gapped breaker point assembly wherein a spacing block is mounted upon the breaker arm.

Another object of this invention is to provide a pre-gapped breaker point assembly wherein a spacing block is removably mounted upon the breaker arm.

One further object of this invention is to provide an improved method for obtaining the appropriate gap distance between contact points in the distributor of an internal combustion engine.

These and other objects and features of the present invention will become more fully apparent from the following description and appended claims taken in conjunction with the accompanying drawing.

DETAILED DESCRIPTION OF THE PREFERRED EMBODIMENTS

The invention is best understood by reference to the figures wherein like parts are designated with like numerals throughout.

Replacement breaker point assemblies for distributors of internal combustion engines are generally available as a complete, pre-assembled unit. The breaker point assemblies include a bracket having an upwardly extending flange upon which a first contact point is mounted. A second, movable contact point is mounted on a spring-biased, oscillatory breaker arm. The breaker arm includes a cam follower which is spring-biased toward a cam so as to impart an oscillatory movement to the movable contact point. The cam follower urges its respective breaker arm and, correspondingly, movable contact point to its maximum separation distance from the fixed contact point when the cam follower is at a high point on the cam.

Figure 1:
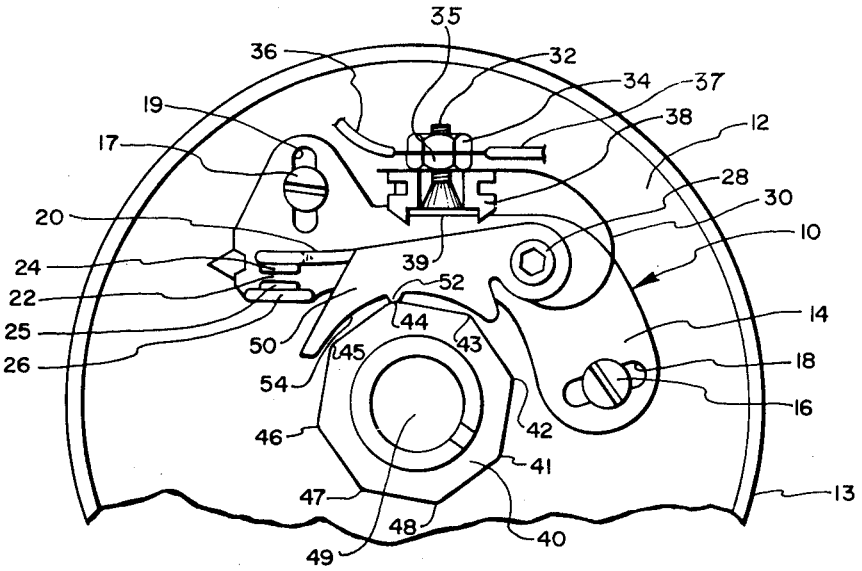
FIG. 1 is a plan view of a breaker point assembly incorporating a first preferred embodiment of the spacing block of the present invention, the breaker point assembly being shown in the environment of a distributor, portions of the distributor being broken away for ease of illustration.
Figure 2:
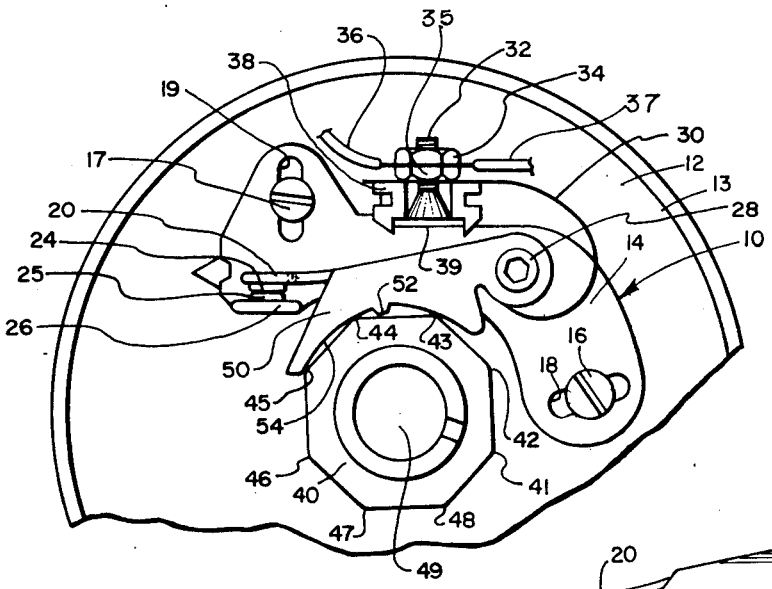
FIG. 2 is a plan view of the breaker point assembly of FIG. 1 with the spacing block and breaker arm in a second operative position relative to the cam.

Referring now more particularly to FIGS. 1 and 2, a breaker point assembly is shown generally at 10 and is secured to a mounting plate 12 of a distributor 13. Breaker point assembly 10 includes a base 14 which is adapted to be adjustably secured to mounting plate 12 by means of screws 16 and 17 cooperating in slots 18 and 19. Base 14 also includes an upright flange 26 which serves as a mounting post for a fixed contact point 25.

An oscillatory breaker arm 20 is pivotally mounted to base 14 by a pivot 28 and is resiliently urged toward a cam 40 by a spring 30. A contact 24 is affixed to the movable end of breaker arm 20 and is thereby adapted for oscillatory movement by the cooperation between a cam follower 52 on breaker arm 20 and cam 40, as will be discussed more fully hereinafter.

Spring 30 is in electrical contact with contact 24 through an electrical lead (hidden) on the back of breaker arm 20. Spring 30 is configurated as a leaf spring and is electrically isolated from base 14 by electrical insulation provided by an insulator 38 mountd on a projection 39 extending from base 14. Spring 30 is clamped to insulator 38 by means of an inner nut 35 and an outer nut 34 cooperating with an insulated bolt 32. Electrical leads 36 and 37 are secured by nuts 34 and 35. Spring 30 thereby provides electrical continuity between electrical leads 36 and 37 and movable contact 24. The remainder of the electrical circuit is completed through fixed contact 25, flange 26 and base 14. The electrical circuitry set forth herein is conventional and well known in the art.

Distributor 13 is mounted in fixed relationship to the engine block (not shown) of an internal combustion engine (not shown) and provides a housing for a shaft 49 upon which the cam 40 is mounted. Mounting plate 12 is a conventional breaker plate in a conventional distributor. Mounting plate 12 is adapted to accommodate limited rotation about shaft 49 in order to change the relative position of the breaker point assembly 10 with respect to a cam 40. This change in relative position accommodates acceleration demands for the internal combustion engine, as is conventional. Shaft 49 is geared for rotation upon operation of the internal combustion engine (not shown) and, correspondingly, rotates cam 40 to cause oscillatory movement of a cam follower 52 and breaker arm 20.

Cam 40 includes a plurality of high points or lobes 41–48 which sequentially strike cam follower 52 (see FIG. 1 and, more particularly, cam lobe 44) so as to move breaker arm 20 and, correspondingly, movable contact 24. Movement of movable contact 24 away from fixed contact 25 provides a gap distance 22 therebetween. Continued movement or rotation of cam 40 causes each respective cam lobe (see cam lobe 44, FIG. 2) to move from underneath cam follower 52 allowing spring 30 to resiliently urge movable contact 24 against fixed contact 25 thereby again closing the electrical circuit.

Figure 5:
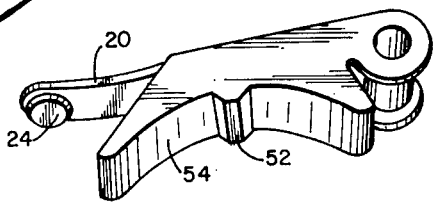
FIG. 5 is a perspective view of the spacing block assembly of FIGS. 1 and 2.

Importantly, spacing block 50 extends an arcuate surface 54 on either side of cam follower 52 and provides a surface which rests against cam 40 and, more particularly, cam lobes 41–48, as appropriate, when cam follower 52 is between lobes 41–48. Under these circumstances, cam follower 52 extends beyond arcuate surface 54 a distance which is proportional to the gap distance 22. Correspondingly, when cam follower 52 is at a high point on cam 40 (see cam lobe 44, FIG. 1) the arcuate surface 54 of spacing block 50 is urged away from cam 40 by a distance which is proportional to the gap distance 22. Accordingly, the relationship between the spacing block 50 and, more particularly, arcuate surface 54, cam follower 52 and movable contact 24 may be selectively preset during manufacture. In particular, the distance by which cam follower 52 extends beyond surface 54 will be proportional to gap distance 22 as determined by the relative distances of cam follower 52 and movable contact 24 from pivot 28. Arcuate surface 54 is more clearly shown in FIG. 5.

THE METHOD

Securement of breaker arm assembly 10 to mounting plate 12 is accomplished by superimposing apertures 18 and 19 over the respective screw holes (not shown) for screws 16 and 17 and thereafter threadedly engaging screws 16 and 17 therein. Prior to securely tightening screws 16 and 17, base 14 of breaker arm assembly 10 is adjusted on mounting plate 12 by movement of apertures 18 and 19 with respect to screws 16 and 17, respectively, until arcuate surface 54 touches at least two of cam lobes 41–48. The adjustment is accomplished by simultaneously bringing movable contact 24 into touching relationship with fixed contact 25. Screws 16 and 17 are then tightened to securely engage base 14 to mounting plate 12. As cam 40 is rotated, each of cam lobes 41–48 will successively strike cam follower 52 thereby forcing movable contact arm 20 away from cam 40 and opening the gap 22 the predetermined gap distance as set by the proportional protrusion of cam follower 52 into the arcuate surface circumscribed by surface 54.

ALTERNATE SPACING BLOCK EMBODIMENTS

Figure 3:
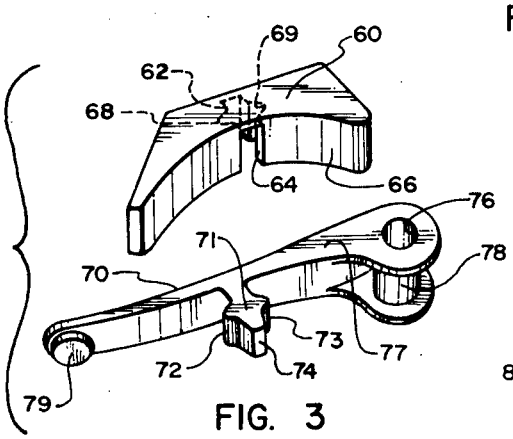
FIG. 3 is an exploded perspective of a second preferred embodiment of the spacing block assembly of this invention.

Referring now more particularly to FIG. 3, a second preferred embodiment of the spacing block of this invention is shown as a removable spacing block 60. Spacing block 60 is adapted to be removably attached to breaker arm 70, as will be set forth more fully hereinafter. Breaker arm 70 includes a hinge portion 77 which is adapted to be mounted upon pivot 28 (FIGS. 1 and 2). Hinge 77 is fabricated from plastic or other insulative material so as to provide the necessary electrical isolation of spring 30 (FIG. 1) between movable contact 79 on breaker arm 70 and base 14 (FIGS. 1 and 2). Hinge 77 includes a bore 76 through which pivot 28 (FIGS. 1 and 2) passes so that hinge 77 and, more particularly, breaker arm 70 may be pivotally mounted on base 14 (FIGS. 1 and 2). Bore 76 is enclosed by a cylindrical sheath 78 around which spring 30 (FIGS. 1 and 2) is curved so as to provide the necessary spring tension to resiliently urge breaker arm 70 toward cam 40 (FIGS. 1 and 2), as set forth hereinbefore. Electrical continuity between spring 30 (FIG. 1) and movable contact 79 is provided by conventional techniques, for example, by an electrical lead (hidden) on the back of breaker arm 70.

Hinge portion 77 of this presently preferred embodiment of breaker arm 70 terminates in a cam follower 71 having a cam follower surface 74 and projecting ears 72 and 73. Projecting ears 72 and 73 accommodate the releasable attachment of spacing block 60 to the cam follower 71. Spacing block 60 includes an arcuate surface 66 and a cutout 62 therein which is adapted to receive cam follower 71. Cutout 62 includes opposed recesses 68 and 69 which dimensionally correspond to ears 72 and 73, respectively. Cam follower surface 74 extends through a notch 64 in arcuate surface 66 a predetermined distance thereby duplicating the features of spacing block 50 (FIG. 1). Importantly, spacing block 60 of this second preferred embodiment is removably attached to breaker arm 70 so that once the breaker point assembly 10 (FIGS. 1 and 2) is tightly secured to mounting plate 12 (FIGS. 1 and 2) spacing block 60 may be removed therefrom and discarded or set aside for any subsequent adjustment requirements.

Figure 4:
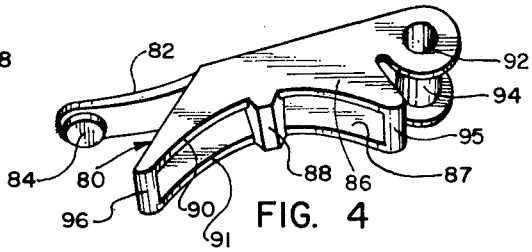
FIG. 4 is a perspective view of a third preferred embodiment for the spacing block assembly of this invention.

Referring now more particularly to FIG. 4, a third preferred embodiment of the spacing block is shown generally at 80 as permanently attached to a breaker arm 82. Spacing block 80 includes a permanently affixed spacing apparatus formed by at least two parallel, planar elements 86 and 87 having parallel arcuate surfaces 90 and 91, respectively. The ends of planar elements 86 and 87 are joined by supports 95 and 96 which reduce the tendency for the respective ends of planar elements 86 and 87 to vibrate upon contact with the rotating cam 40 (FIGS. 1 and 2).

A cam follower 88 extends beyond the arcuate surfaces 90 and 91 an appropriate distance to suitably enable the establishment of an appropriate gap distance 22 (FIGS. 1 and 2) between movable contact 84 and fixed contact 25 (FIGS. 1 and 2). It is currently believed that the two relatively narrow arcuate surfaces 90 and 91 substantially reduce the weight of movable contact arm 80 and, simultaneously, reduce any frictional restraint between the arcuate surfaces 90 and 91 and cam lobes 41–48 (FIGS. 1 and 2).

Breaker arm 82 also includes a movable contact 84 and is adapted to be pivotally mounted to a base 14 (FIGS. 1 and 2) by a pivot 28 (FIGS. 1 and 2) passing through a bore 92 in a cylindrical surface 94. Cylindrical surface 94 is similar in structure and function to cylindrical surface 78 (FIG. 3). Similar electrical continuity between movable contact 84 and spring 30 (FIG. 1) is also provided by conventional techniques, for example, by an electrical lead (hidden) on the back of breaker arm 82.

It should be particularly noted that the curvature of each of the respective arcuate surfaces, arcuate surface 54 (FIGS. 1, 2 and 5), arcuate surface 66 (FIG. 3), and arcuate surfaces 90 and 91 (FIG. 4), substantially corresponds to the arc circumscribed by cam lobes 41–48 (FIGS. 1 and 2) when cam 40 (FIGS. 1 and 2) is rotated. The corresponding curvatures permit the respective movable contacts in each embodiment to remain touching fixed contact 25 (FIGS. 1 and 2) until lifted away by the action of the respective cam follower being successively raised by cams 41–48 (FIGS. 1 and 2).

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by a United States Letters Patent is:

1. A breaker point assembly for a distributor of an ignition system for an internal combustion engine, said breaker point assembly being adapted to be adjustably mounted on a movable breaker mounting plate in said distributor, said breaker point assembly being secured in proximity to a cam of said distributor, said breaker point assembly having a cam follower resiliently urged toward said cam and having a breaker arm extending therefrom, the breaker arm terminating in a first breaker contact point, the cam follower being operable between said cam and said breaker arm so as to impart an oscillatory movement to the breaker arm thereby intermittently separating said first contact point from a second contact point coincident with a high point on said cam, the first contact point being electrically isolated from the second contact point; the improvement including a self-adjustable cam follower structure, the structure comprising:

a spacing block mounted on said breaker arm, said spacing block including an arcuate cam abutment surface, the curvature of the arcuate abutment surface corresponding to an arc circumscribed by the cam and adapted to be resiliently urged against said cam; said breaker arm including a cam follower, said cam follower extending a predetermined distance from the arcuate abutment surface, said predetermined distance being proportional to a predetermined gap distance between said first and second contact points, the can follower thereby being adapted to resiliently urge said first contact point away from said second contact point said predetermined gap distance coincident with a high point on said cam, said cam follower being suspended between high points on said cam when said arcuate abutment surface of said spacing block is resiliently urged against said cam thereby permitting the first contact point to touch the second contact point.

2. The improvement of claim 1 wherein said spacing block is removably mounted on said breaker arm.

3. The improvement of claim 1 wherein the arcuate abutment surface comprises at least two, parallel arcuate abutment surfaces spaced one from the other.

4. A method for establishing a predetermined gap distance between a first, movable contact point and a second, stationary contact point of a breaker point assembly for an ignition system of an internal combustion engine the first, movable contact point being mounted for oscillatory movement imparted by a cam, comprising the steps of:

securing a spacing block to a breaker arm of a breaker point assembly, the breaker point assembly having a base and a second contact point mounted in fixed relationship to the base and in electrical continuity with the base, pivotally mounting the breaker arm to said base, the breaker arm having a first contact point, the first contact point being resiliently urged against the second contact point, the base being adapted to be secured to a mounting plate of a distributor of an ignition system for an internal combustion engine, the spacing block having an arcuate surface corresponding to an arc circumscribed by said cam, the spacing block including a cam follower formed as a protrusion extending from the arcuate surface of the spacing block, the distance of protrusion being selectively predetermined to be proportional to a predetermined gap distance between said first and said second contact points; and providing securing means for mounting the base of the breaker point assembly to a movable mounting plate of a distributor so that the arcuate abutment surface of the spacing block will rest against the cam to thereby accommodate simultaneously adjusting the base with respect to the mounting plate so as to have the first contact point touch the second contact point and thereafter securing the base to the mounting plate.

* * * * *